166-307 SR
3/23/76 KR 3,945,436

United States Patent [19]

Nebolsine

[11] 3,945,436

[45] Mar. 23, 1976

[54] METHOD AND APPARATUS FOR CLEANSING WELL LINER AND ADJACENT FORMATIONS

[76] Inventor: Rostislav Nebolsine, 64 E. 86th St., New York, N.Y. 10028

[22] Filed: Jan. 7, 1975

[21] Appl. No.: 539,111

[52] U.S. Cl. ..... 166/303; 166/307; 166/312; 166/187; 166/191

[51] Int. Cl.[2] ..... E21B 33/124; E21B 33/127; E21B 43/24

[58] Field of Search ..... 166/312, 307, 311, 304, 166/146, 147, 191, 187, 303

[56] References Cited

UNITED STATES PATENTS

| | | | |
|---|---|---|---|
| 2,221,775 | 11/1940 | Boynton | 166/146 X |
| 2,290,141 | 7/1942 | Burt | 166/312 |
| 2,341,832 | 2/1944 | Verheul et al. | 166/146 |
| 2,512,801 | 6/1950 | Kinney et al. | 166/312 X |
| 3,020,960 | 2/1962 | Hayward | 166/146 |
| 3,760,878 | 9/1973 | Peevey | 166/311 X |
| 3,861,465 | 1/1975 | Mignotte | 166/312 X |

*Primary Examiner*—Stephen J. Novosad
*Attorney, Agent, or Firm*—Darby & Darby

[57] ABSTRACT

First, a cleansing fluid is injected under high pressure into a well liner and out through the apertures in the liner so as to travel through a particular slice of the underground formation adjacent the lining in order to dissolve chemical deposits and dislodge physical obstructions. Then, an entraining fluid is injected into the well liner under high pressure and into the formation in order to entrain the dissolved or dislodged particles in the formation and carry them into the well. Next, the captured particles are pumped out of the well to the surface for eventual disposal.

The cleansing and entraining fluids are injected into a flexible hose which is connected to a high pressure source. The hose is surrounded by a pipe which carries the particles flushed from the underground formation to the surface. The pipe is surrounded by a series of packers which are inflated by the injected fluids. Outlet ports for the injected fluids are positioned between — in vertically descending order — first and second packers and between third and fourth packers; an inlet port for the entrained fluid is positioned between the second and third packers.

7 Claims, 2 Drawing Figures

METHOD AND APPARATUS FOR CLEANSING WELL LINER AND ADJACENT FORMATIONS

This invention generally relates to a method and apparatus for cleansing well liners and the formations adjacent the well liners or surrounding a drilled-in open hole and has particular applicability with respect to oil wells.

Generally, the production of oil or other fluids from underground wells drops off due to three main causes. The first cause is that the extraction of the fluid from the confined underground formation results in a drop of pressure in the remaining fluid present in that section of the underground formation. The second cause is due to the obstruction of the apertures in the liner (or casing) of the well, due to either physical blocking of these openings by particles detached from the underground formation or by chemical deposits within the openings. The chemical deposits result from the release of gases by the fluid due to a drop in pressure in the fluids as they enter the well. The release of gases causes precipitation of certain chemicals that were held in solution at the higher pressures.

A third cause relates to obstructions that are created in the underground formation itself, particularly obstructions that are close to and adjacent to the well liner or the drilled-in open hole. As fluid (oil) is extracted from the underground formation, the smaller loose grains of sand or detached particles from the consolidated strata or debris that is forced out into the underground formation by well aperture cleansing operations, are entrained by the fluid moving towards the well. All such loosened material does not pass through the well liner apertures. Some of it is lodged against the liner and some of it fills up the voids in the formation surrounding the liner. This results in a reduction in the permeability of the underground formation in the particular zone where transmissability is most desirous. Also, the loss in pressure of the fluid approaching the well, described above, causes the precipitation of certain chemical deposits into the formation adjacent the well liner and further reduces the permeability of the formation. Both the physical and chemical clogging of the formation adjacent the well liner are cumulative in effect so that the production of fluid from a well drops and may cease altogether as a result of this third cause.

With respect to the second cause, efforts have been directed to removing the obstructions and deposits in the apertures in the well casings or liners by successively injecting cleansing fluids through the apertures of a particular section of the well liner that is sealed off by closely spaced, nonelongated upper and lower packers. This injection continues for a period sufficient to dissolve or weaken and detach the particles or deposits in the apertures. The debris enters the well together with the pressurized fluid through apertures either above or below the isolated section of the well. The debris is either carried upward with the fluids being pumped out of the well or permitted to drop to the bottom of the well from which it can be later removed by a bailer-type device. Such operations using appropriate cleansing apparatus and cleansing fluids have been effective in opening up the apertures in well casings and liners quite effectively thereby increasing the permeability of the well casing or liner.

This invention is primarily directed to solving the third cause of fluid production drop-off discussed above by selectively reaching and treating the affected portions of the underground formation nearest the well and most affected by clogging due to physical obstructions and chemical deposits. Briefly, the method of this invention consists of first, injecting an acid or some other cleansing or caustic fluid through the apertures in an isolated section of the well liner. The purpose of this step is to loosen or dissolve the physical and chemical deposits in the underground formation adjacent the well liner. The second step involves injecting water or steam or any suitable fluid or gas into the underground formation adjacent the well to entrain the dissolved or detached physical or chemical deposits and cause such deposits to enter the well through the well liner apertures. The third step involves removing the entrained deposits as they enter the well by pumping the fluid to the surface or by lowering a suction tube into the well.

In order to effectively practice the method of this invention, a specific apparatus has been developed. Briefly described, this apparatus consists of a series of elongated packers which surround a centrally located section of pipe which is hung from a smaller diameter flexible hose or pipe which extends within the first pipe and which is fed from a large diameter winch or drum at the surface. A cable may also be used as an auxiliary support for the apparatus.

In a preferred embodiment of my invention, the innermost hose or pipe is used to transport the fluid which is injected into the formation adjacent the well liner. A fluid outlet is located between a first elongated packer and a second elongated packer and a fluid inlet which leads to the outermost pipe is located between the second elongated packer and a third elongated packer. Another fluid inlet may be located between the third elongated packer and a fourth elongated packer. This results in a relatively lower pressure zone being formed between the second and third elongated packers. Consequently, when fluid is injected into and through the innermost pipe under high pressure, it is ejected through the fluid outlet ports between the first and second packers and the third and fourth packers, through the apertures in the well liner and into the underground formation directly adjacent and outside of the well liner. Since the fluid is under high pressure, it necessarily travels towards the lower pressure zone between the second and third elongated packers, as described in more detail below.

It is important that the packers between the fluid outlet ports and the fluid inlet ports be elongated so that the first injected fluid travels a sufficient distance through the underground formation to dissolve the chemical deposits and loosen the physical obstructions in the underground formation adjacent the well liner and so that the second injected fluid entrains the dissolved chemical deposits or detached physical obstructions and causes such particles to enter the well through the well casing liner at the low pressure zone between the elongated packers. The ellongated packers serve to maintain a high pressure barrier along the well liner to prevent the fluid which is injected into the underground formation from short-circuiting back into the well without traveling through the underground formation. This happens when non-elongated disctype packers are closely spaced. The length of the elongated packeers positioned between the fluid outlet ports and the fluid inlet zone determine the shape of the fluid flow net which in turn determines the radial distance from the center of the well to which the underground formation is treated according to the method of this invention.

In practicing the method of my invention, the apparatus described above is lowered into a well by a flexible pipe or cable. The apparatus is lowered to a section of the underground formation that it is desired to treat according to the method of this invention. When the apparatus of my invention is being lowered into the well, the packers are in a deflated condition so as not to obstruct the descent of the apparatus down the well which may not be straight. When the section of the underground formation to be treated has been reached, a cleansing or caustic or solvent fluid under high pressure is injected into the innermost pipe, into the inflatable packers and through the fluid outlet ports located between the first and second packers and the third and fourth packers. This automatically inflates the packers which engage the walls of the liner or, in the case of an open hole, the exposed cylindrically shaped surface of the formation. The high pressure fluid is given sufficient time to travel the length of the elongated packers to the low pressure zone between the second and third packers. Then, after a period of time, a second high pressure fluid is injected into the innermost pipe and out through the outlet ports into the underground formation to entrain the loosened chemical deposits and physical obstructions. The entraining fluid is given sufficient time to capture the physical and chemical particles and cause them to be moved through the low pressure zone between the second and third packers and then upward through the centrally located pipe. The removal of the debris from the well can be aided by means of an air lift or suction pipe lowered into the casing. If the deposits fall to the bottom of the well, they may later be removed by the bailer-type device.

In the event that there is a great accumulation of loose particles lodged against the walls of the casing or liner, it may be necessary to cut additional apertures in the well liner at such points or to enlarge the apertures that are there so as to be able to remove these deposits from the well. After a particular slice of the underground formation adjacent the well casing has been cleansed, the packers are deflated, the apparatus is lowered or raised to the next section to be cleansed and the operation described above is repeated. This can be programmed automatically.

The effect of practicing the method of my invention is that the permeability of the underground formation adjacent the well liner is increased so as to permit the greater flow of fluid, particularly oil, towards and into the well.

Structural features of the invention and the complete nature thereof will become increasingly apparent following a consideration of the ensuing specification and the appended claims in which the invention is defined, particularly when taken in conjunction with the accompanying illustrative drawings setting forth a preferred embodiment of the invention.

BRIEF DESCRIPTION OF THE DRAAWINGS

FIG. 1A is a cross-sectional view of a portion of a well showing the uppermost portion of the apparatus of this invention; and FIG. 1B is a cross-sectional view of a continuation of the well illustrated in FIG. 1A showing the lowermost portion of the apparatus of this invention.

DESCRIPTION OF A PREFERRED EMBODIMENT

Figure 1A:
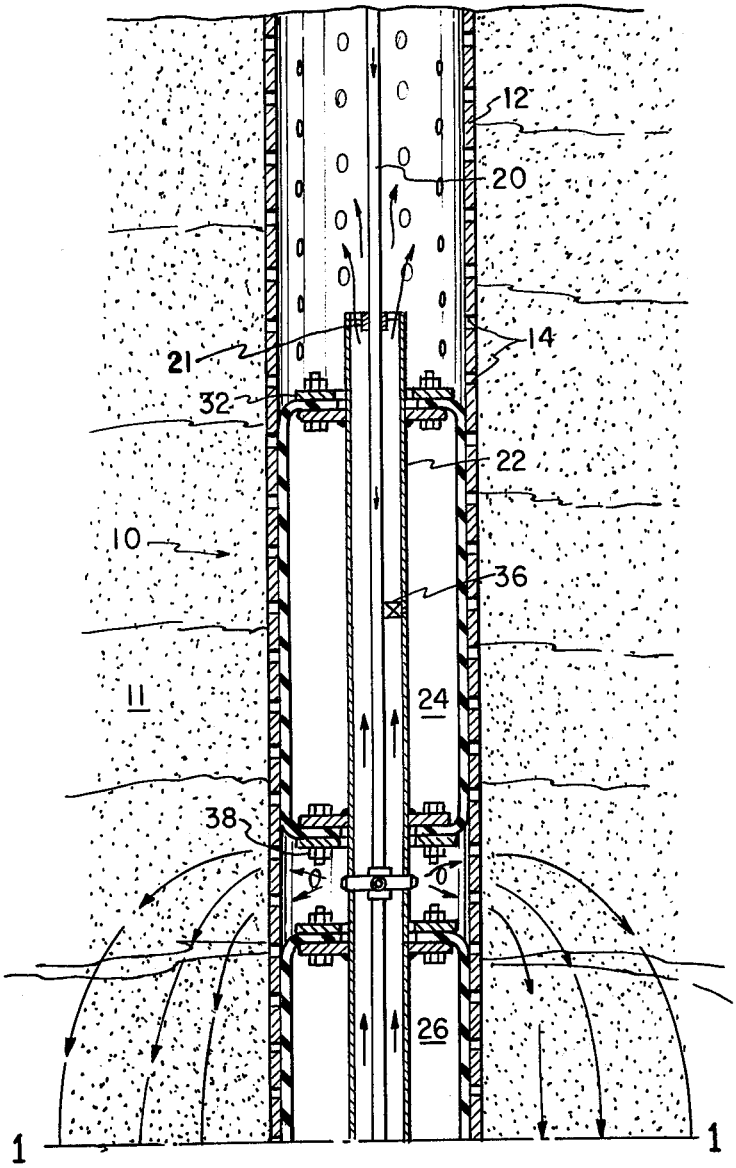

Referring to FIG. 1A, a portion of a well 10 in an underground formation 11 is illustrated. The well is defined by a well casing or liner 12 which contains numerous perforations or apertures 14. The purpose of these apertures is, of course, to permit the water or oil in the adjacent underground formation to enter into the well. Well liners in the vicinity of oil-producing formations are generaly six to fifteen inches in diameter.

The apparatus of this invention is lowered into the well by a flexible hose or pipe 20 approximately one inch in diameter. Flexible pipe 20 consists of a continuously welded steel pipe that is wound and unwound from a large diameter drum well known in the oil-drilling industry. A cable (not shown) can be used to help support the well-cleansing apparatus. On the surface, the pipe 20 is connected to source (not shown) of high pressure fluids using a drum designed for this purpose.

Surrounding the inner pipe 20 is an outer pipe 22 which is generally two to four inches in diameter. The outer pipe 22 is attached to and hung from the inner pipe 20 by a welded web connection 21.

Surrounding the outer pipe are a series of packers which are referred to here in descending order as the first packer 24, the second packer 26, the third packer 28, and the fourth packer 30. Packers 24, 26, 28 and 30 each comprises unitary inflatable members which may be composed of rubber or any other suitable inflatable material. Packers 24, 26 and 28 are fastened to U-shaped flanges 32 which are welded onto the outer surface of outer pipe 22 and which extend radially outwardly from pipe 22. The upper portion of packer 30 is also fastened to a U-shaped flange welded to outer pipe 22. The bottom portion of packer 30 is fastened to the base of the penetration cone 34 which is the first part of the apparatus to enter the well.

The packers 24, 26, 28 and 30 may range in size from two to five times the diameter of the well liner. If the well liner has a small diameter, the length of the packer would tend to be closer to five times the size of the well liner diameter whereas if the diameter of the well liner is large, the length of the packer would tend to be closer to two times the diameter of the well liner. Thus, depending on the size of the well liner, the length of the packers 24, 26, 28 and 30 would be in the range between one and a half feet and four feet. The elongation of the packers 24, 26, 28 and 30 is important in order to insure that the fluid which is injected into the formation adjacent the well casing or liner actually travels through the formation in curvilinear paths rather than short-circuiting back towards the apertures in the well liner as occurs with closely spaced, non-elongated packers. Movable collars (not shown) could be attached to the outer pipe 22 in place of the welded flanges 32 so that the pipe 22 could accommodate packers of various dimensions, depending on well size and the permeability of the formation to be cleansed.

In the preferred embodiment illustrated in the drawings, the packers 24, 26, 28 and 30 are approximately seven inches in diameter, when inflated.

When the apparatus of this invention is lowered into the well, the packers 24, 26, 28 and 30 are initially deflated so as not to offer any resistance to the lowering of the apparatus into the well casing or liner. When the apparatus is positioned adjacent the underground formation to be cleansed, the packers 24, 26, 28 and 30 are inflated by connecting the hose 20 to a high pressure fluid supply (not shown) which inflates the packers through inlet ports 36. The packers 24, 26, 28 and 30 are inflated sufficiently to form a fluid-tight seal with the inner walls of the well liner.

Initially, the fluid under high pressure to which hose 20 is connected consists of an acid or detergent or deemulsifier or caustic fluid. This fluid, which will be generally referred to as a cleansing fluid, is supplied to inner pipe 20 and injected into the underground formation directly adjacent the well liner through fluid outlet ports 38 and 40 and then through the apertures 14 in the well liner. It is noted that port 38 extends outwardly past outer pipe 22 whereas the port 40 does not. The port 40 may also extend outwardly past outer pipe 22 but it is not necessary in the embodiment of my invention illustrated in the drawings because packing material 42 is provided around inner pipe 20 for the entire length of the third packer 28. This packing material 42 prevents the cleansing fluid from traveling up outer pipe 22. Slots 46 are provided in the outer pipe 22 to provide an exit for the cleansing fluid emitted from port 40.

Figure 1B:
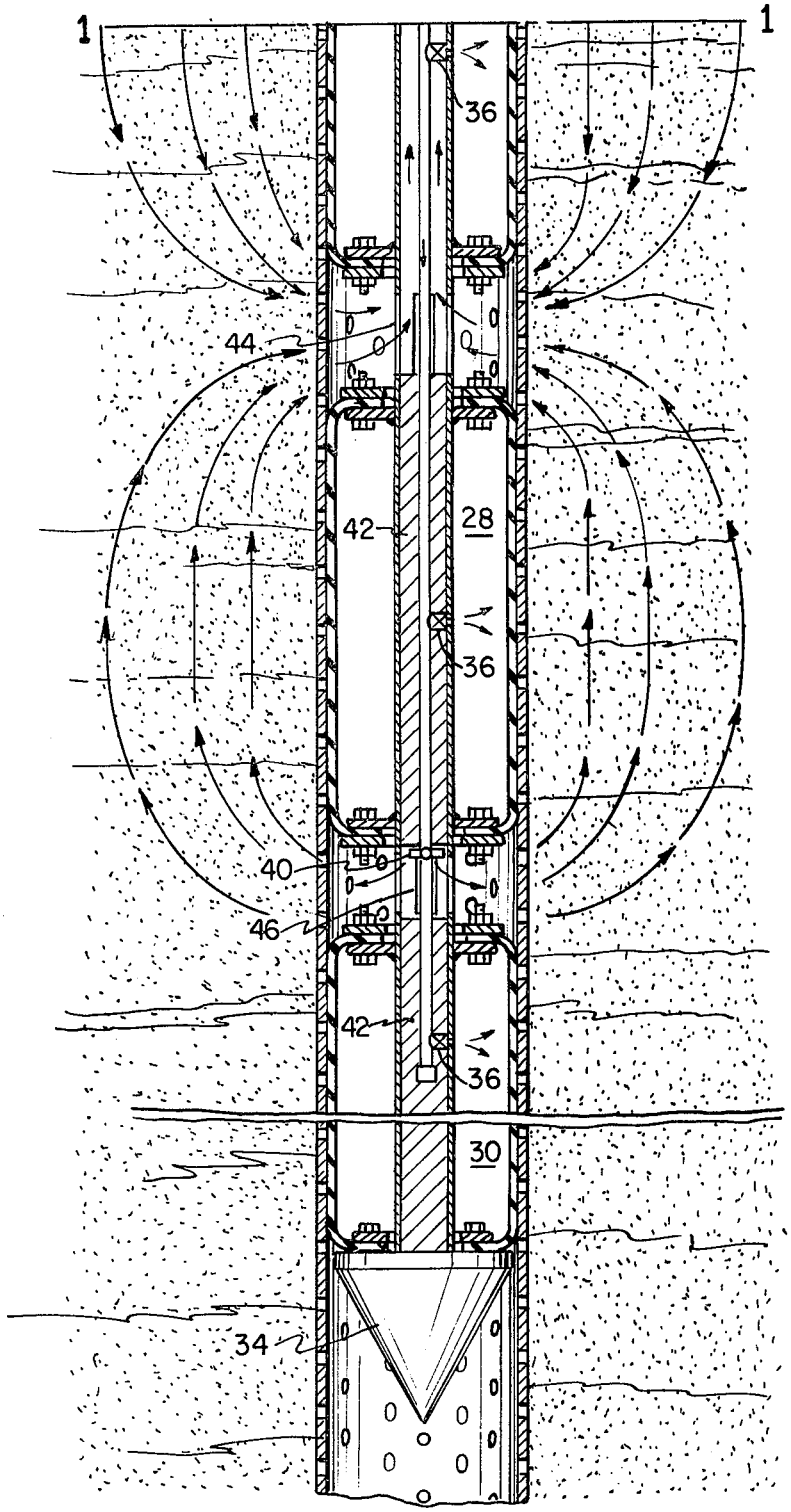

The cleansing fluid which is injected into the underground formation dissolves or loosens the physical and chemical deposits in the formation. Then, the hose 20 is connected to a supply (not shown) of a second fluid under high pressure. This second fluid may consist of water or steam or heated or unheated oil or any other suitable fluid which serves to entrain the loosened or dissolved particles in the underground formation and carry such particles into the well through the well casing or liner apertures. This fluid will generally be referred to as the entraining fluid. The entraining fluid enters inner pipe 20 and is emitted through outlet ports 38 and 40 in the same manner as the cleansing fluid. The entraining fluid travels through the underground formation, as indicated by the flow lines in FIGS. 1A and 1B, towards the low pressure zone which is located between the second packer 26 and the third packer 28. There, the entraining fluid, carrying the dissolved or detached physical and chemical deposits from the formation, enters the well through the well casing or liner apertures and enters outer pipe 22 through slots 44.

The elongated packers of this invention prevent the short-circuit entrance of the cleansing fluids or the entraining fluids which have been injected into the oil-producing formation back into the well. Thus, the paths of the pressurized cleansing and entraining fluids passing through the porous formation back into the well follow an equipotential type of flow net. This means that a considerable portion of the cleansing and entraining fluid will flow outwardly in arc-shaped paths that will bring the cleansing and dissolving fluids into contact with the formation at a considerable distance away from the circumference of the well casing or liner, as illustrated in the drawings, instead of moving vertically along the walls of the casing or liner into the apertures immediately above and below the dissolving and cleansing fluid injection zone. The horizontal distances to which the cleansing and entraining fluid flows depends on the length of the particular packers and the nature of the formation.

A suction pipe or air lift (neither shown) may be lowered into the well to pump the entraining fluid carrying the formation deposits to the surface for eventual disposal.

In the event that there is a great accumulation of particles at the low pressure zone between the second and third packers, it may be necessary to cut additional apertures in the well casing wall or liner at that point or to enlarge the apertures presently there in order to enable the particles to enter the well. This could be accomplished by numerous means well known in the art.

After the cleansing and entraining operations are performed in a particular slice of the underground formation, the packers 24, 26, 28 and 30 are deflated and the entire apparatus is raised or lowered in the well to the next position opposite a new slice of the formation at which the cleansing, entraining and debris removal operations are to be performed. Then, the entire operation described above is repeated. The supplying of cleansing and entraining fluids and the raising and lowering of suction pipe and the cleansing apparatus can be programmed so that it is accomplished automatically.

Although the embodiment of my invention described above utilizes four packers, the method of my invention could be practiced by utilizing only the first and second packers and by locating the fluid inlet port 38 between the first packer and the second packer and locating the low pressure zone, that is, the slots 24 in pipe 22, below the second packer. This would provide a single flow new pattern rather than the dual flow net pattern illustrated in the drawings.

It is conceivable that upon examining the foregoing disclosure, those skilled in the art may devise embodiments of the concepts involved which differ somewhat from the embodiments shown and described herein, or may make various changes in structural details for the present embodiment. Consequently, all such changed embodiments or variations in structure as utilize the concepts of the invention and clearly incorporate the spirit thereof are to be considered as within the scope of the following claims.

What is claimed is:

1. A method for cleansing well liners or the walls of an open cavity, and the adjacent underground formations, comprising the steps of:

sealing a first length of the liner or cavity walls and a second length of the liner or cavity walls spaced from and positioned below the first length against fluid flow;

first injecting a first fluid such as an acid, detergent, de-emulsifier or caustic fluid through the liner or cavity walls between the first and second sealed lengths and into the adjacent underground formation in order to cleanse the underground formation;

then injecting a second fluid such as water, steam or oil through the liner or cavity walls between the first and second sealed lengths and into the underground formation in order to entrain the loosened or dissolved particles in the underground formation and then recovering the entrained fluid from the underground formation through the liner or cavity walls below the second sealed length.

2. The method of claim 1 wherein in the step of sealing, the sealed lengths of the liner or cavity walls are sufficiently long to cause the cleansing fluid and the entraining fluid to flow outwardly through the formation in arc-shaped paths at a distance away from the liner or cavity.

3. Apparatus for cleansing well liners having apertures or the walls of an open cavity, and the adjacent underground formations, comprising:

a first pipe adapted to be positioned within a well;
a second pipe positioned within said first pipe;
a pressurized cleansing fluid source and a pressurized entraining fluid source, and means for connecting said fluid sources to said second pipe;
a first elongated packer surrounding said first pipe;
a second elongated packer surrounding said first pipe, said second packer being positioned vertically below and spaced from said first packer, the length of said first and second packers being in the range of two to five times the diameter of the well liner or open cavity within which said packers are to be positioned so that the sealed lengths of the liner or cavity are sufficiently long to cause the cleansing fluid and the entraining fluid to flow outwardly through the underground formation in arc-shaped paths at a distance away from the liner or cavity;
a fluid outlet port communicating with said second pipe and extending through said first pipe, said outlet port being positioned between said first and second packers;
a fluid inlet port communicating with said first pipe and being positioned below said second packer.

4. Apparatus for cleansing well liners having apertures or the walls of an open cavity, and the adjacent underground formation, comprising:
a first pipe adapted to be positioned within a well;
a second pipe positioned within said first pipe;
a first elongated packer surrounding said first pipe;
a second elongated packer surrounding said first pipe, said second packer being positioned vertically below and spaced from said first packer;
a fluid outlet port communicating with said second pipe and extending through said first pipe, said outlet port being positioned between said first and second packers;
a fluid inlet port communicating with said first pipe and being positioned below said second packer;
said second pipe consisting of a flexible pipe extendible from the surface into the well, said first pipe being attached to said second pipe for supporting said first pipe within a well and for raising and lowering said first pipe within a well.

5. Apparatus for cleansing well liners having apertures or the walls of an open cavity, and the adjacent underground formations, comprising:
a first pipe adapted to be positioned within a well;
a second pipe positioned within said first pipe;
a first elongated packer surrounding said first pipe;
a second elongated packer surrounding said first pipe, said second packer being positioned vertically below and spaced from said first packer;

a fluid outlet port communicating with said second pipe and extending through said first pipe, said outlet port being positioned between said first and second packers;
a fluid inlet port communicating with said first pipe and being positioned below said second packer;
a third elongated packer positioned below and spaced from said second elongated packer and a fourth elongated packer positioned below and spaced from said third elongated packer; a second fluid outlet port communicating with said second pipe and extending through the first pipe being positioned between said third and fourth packers.

6. Apparatus for cleansing well liners having apertures or the walls of an open cavity, and the adjacent underground formations comprising:
a first pipe adapted to be positioned within a well;
a second pipe positioned within said first pipe;
a first elongated packer surrounding said first pipe; a second elongated packer surrounding said first pipe, said second packer being positioned vertically below and spaced from said first packer, a third elongated packer surrounding said first pipe, said third packer being positioned vertically below and spaced from said second packer, a fourth packer surrounding said first pipe, said fourth packer being positioned vertically below and spaced from said third packer, the length of said first, second, third and fourth packers being in the range of two to five times the diameter of the well liner or open cavity within which said packers are to be positioned, said first, second, third and fourth packers being inflatable so as to engage the walls of the liner or cavity;
fluid outlet ports in communication with said second pipe and extending through said first pipe being positioned between first and second packers and between said third and fourth packers;
a fluid inlet port in communication with said first pipe being positioned between said second and third packers,
a pressurized cleansing fluid source connected to said second pipe for injecting said cleansing fluid through said fluid outlet ports and into the adjacent underground formation;
a pressurized entraining fluid source connected to said second pipe for injecting said entraining fluid through said fluid outlet ports, through the adjacent underground formation and back into said first pipe through said fluid inlet port.

7. The apparatus recited in claim 6, said first, second, third and fourth packers being inflatable by the injection of said cleansing fluid.

* * * * *